US008434437B2

(12) United States Patent
Gemein et al.

(10) Patent No.: US 8,434,437 B2
(45) Date of Patent: May 7, 2013

(54) VALVE DRIVE SYSTEM

(75) Inventors: Stefan Gemein, Furth (DE); Lucia Hinkovska, Herzogenaurach (DE); Arne Manteufel, Bamberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 361 days.

(21) Appl. No.: 12/767,249

(22) Filed: Apr. 26, 2010

(65) Prior Publication Data

US 2010/0275864 A1 Nov. 4, 2010

(30) Foreign Application Priority Data

Apr. 30, 2009 (DE) ..... 10 2009 019 680

(51) Int. Cl.
*F01L 1/34* (2006.01)
*F01L 1/18* (2006.01)

(52) U.S. Cl.
USPC ..... 123/90.16; 123/90.44

(58) Field of Classification Search ..... 123/90.16, 123/90.44
See application file for complete search history.

(56) References Cited

U.S. PATENT DOCUMENTS

| | | | | |
|---|---|---|---|---|
| 7,159,551 | B2 * | 1/2007 | Cecur et al. | 123/90.45 |
| 7,637,237 | B2 * | 12/2009 | Evans et al. | 123/90.48 |
| 2005/0247279 | A1 * | 11/2005 | Rorig et al. | 123/90.16 |
| 2007/0101958 | A1 * | 5/2007 | Seitz | 123/90.16 |
| 2008/0196683 | A1 * | 8/2008 | Hayman et al. | 123/90.46 |
| 2009/0000584 | A1 * | 1/2009 | Rorig et al. | 123/90.39 |
| 2009/0007872 | A1 * | 1/2009 | Bugescu | 123/90.55 |
| 2009/0056653 | A1 * | 3/2009 | Schmidt et al. | 123/90.16 |
| 2011/0005483 | A1 * | 1/2011 | Manther et al. | 123/90.39 |

FOREIGN PATENT DOCUMENTS

| | | |
|---|---|---|
| EP | 1143120 | 10/2001 |
| EP | 1143120 A2 * | 10/2001 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

A valve drive system (1) having a support element (2) and a switchable cam follower (3) that is linked on this support element in an articulated way is provided. The cam follower (3) is made from an outer lever (4) between whose arms (5) runs an inner lever (6), wherein at least the outer lever (4) is provided on its top side (7) with a contact surface (8) for a lifting cam, n the inner lever (6) has, on a bottom side (9) on a first end (10), a contact (11) for a gas-exchange valve and at least on the other end (12) two side walls (13) that are spaced apart and in which extend opposing boreholes (14). The side walls (13) are bridged by a tubular axle piece (15) that sits in the boreholes (14) and in whose opening (16) run two diametrically opposed coupling pistons (17). The axle piece (15) sits between the side walls (13) in a cross borehole (18) of a head (19) of the support element (2), and in the region of the first end (10), the levers (4, 6) sit on a common swivel pin (20) and the arms (5) of the outer lever (4) have, on the other end (12), a catch surface (21) for the coupling pistons (17) that can be brought out from its opening (16) in engagement with the catch surface (21) section-wise in the coupled state, such that a large valve stroke is realized, and for decoupling, a comparatively smaller valve stroke is presented. The outer lever (4) is forced back by a restoring spring (22) from its pivot mode.

15 Claims, 4 Drawing Sheets

VALVE DRIVE SYSTEM

CROSS-REFERENCE TO RELATED APPLICATIONS

This application claims the benefit of German Patent Application No. 10 2009 019 680.3, filed Apr. 30, 2009, which is incorporated herein by reference as if fully set forth.

FIELD OF THE INVENTION

The invention relates to a valve drive system with a support element and a switchable cam follower linked to this support element in an articulated way.

BACKGROUND

The valve drive system emerging from EP 1 143 120 A2 is considered to be the closest prior art. Here, a cam follower is connected on one end to a head of a support element in an articulated way. Coupling pistons that can be displaced, for the coupled case, by the force of a compression spring directly into a borehole of the head of the support element sit, in the decoupled case, in bushings of side walls of the cam follower. On the inside at the ends, the coupling pistons contact slides of the borehole of the support element that can be loaded, for a decoupled case, on their inner ends with hydraulic medium and that exert a force outward in the radial direction onto the coupling pistons. Thus, there is a complicated slide assembly. In the decoupled case, the cam follower detached from the head of the support element pivots in the direction of the support element, wherein its restoring position in the cam direction is realized by a helical compression spring (lost-motion spring) enclosing the support element and sitting in the cylinder head on one end.

For the construction noted above, it is disadvantageous that this construction cannot perform partial strokes and thus gives only limited variability. In addition it has been determined that through the arrangement of the coupling pistons in the pivoting cam follower, its mass moment of inertia is increased unnecessarily and the cylinder head of the combustion engine must be changed for integration of the helical compression spring. In addition, in the decoupled mode there is the risk that the cam follower pivots so far that the borehole of the head of the support element is exposed and thus the slides are no longer secured.

SUMMARY

Therefore, the objective of the invention is to create a valve drive system of the type noted above in which the listed disadvantages are eliminated. In particular, a reliably switching valve drive system that can be delivered as one structural unit should be created and that has a small mass moment of inertia with simultaneously greater variability compared with the state of the art.

This objective is met by the invention. Here, a valve drive system is provided whose cam follower linked in an articulated way includes an outer lever between whose arms runs an inner lever, wherein at least the outer lever is provided on its top side with a contact surface for a lifting cam, the inner lever has, on a bottom side on a first end, a contact for a gas-exchange valve and at least on the other end two side walls that are spaced apart and in which opposing boreholes extend, with the side walls being bridged by a tubular axle piece sitting in the boreholes in whose opening two diametrically opposed coupling pistons run. The axle piece sits between the side walls in a cross borehole of a head of the support element, and, in the region of one end, the levers run on a common swivel pin and the arms of the outer lever have, on the other end, a catch surface for the coupling pistons that can be brought into engagement with the catch surface, in the coupled case, section-wise, out from their opening such that a large valve stroke is realized, and, when decoupled, a comparatively smaller valve stroke or a zero valve stroke is presented, and the outer lever is forced back by a restoring spring from its pivot mode.

Thus a valve drive system is provided in which the disadvantages described above are eliminated.

A tilt-free assembly unit is created whose costs are kept within limits. Due to the articulated connection on the head of the support element (pressure piston), a safety device against spalling is simultaneously also provided. Due to the decoupling mechanism implemented in the axle piece and the arrangement of additional, essential components, such as the restoring spring in the support element region, a valve drive system with a relatively small mass moment of inertia is proposed (also in the decoupled state). Because the restoring spring that is formed in one refinement of the invention as at least one rotary leg spring is integrated into the lever system, the changes described above in the cylinder head region can be eliminated.

Due to the possibility of its two-stage construction (full stroke/partial stroke), the valve drive system has greater variability than the system according to the prior art described above. However, it is also conceivable and provided to represent a valve stroke deactivation by the proposed valve drive system.

For the tubular axle piece in the head of the support element, a simple mass part can be used. As the coupling pistons, in particular, cylindrical elements are conceivable, but it is also provided to flatten these in the coupling region. Likewise, the invention also functions with only one coupling piston.

It is especially preferred when both levers (outer lever, inner lever) are made from a lightweight material, such as thin-walled sheet steel. For production, a stamping-bending method can be used. It is also provided to produce the levers, e.g., by casting material or the like.

One simple variant of a construction of the outer lever provides that its arms should reach only up to the axle stumps and should be provided there with a half-shell-like or quarter-shell-like, roof-like segment as a catch surface. In the coupled case, the corresponding segment grips over the extended coupling pistons section-wise, so that a large valve stroke is possible, wherein simultaneously the corresponding coupling pistons meet, on an inner end of the segment, a stop in the extension direction.

According to another preferred refinement of the invention, the coupling pistons are shifted in their coupling direction by hydraulic medium that can be led out from the support element. A simple displacement in its decoupling direction is proposed by the force of an outer spring that is formed, for example, in an additional realization, as a simple staple that bridges an end region of the lever on the other end with its middle piece and that acts with its end pieces running on arms on outer ends of the coupling pistons.

Optionally, a displacement of the coupling pistons in their coupling direction can take place via a spring force and they can move hydraulically in the decoupling direction. In addition, it is conceivable and provided to displace the coupling pistons in at least one direction by an electromagnetically loaded actuating element or the like. Optionally, its displacement in both displacement directions is possible by hydraulic medium pressure or by an electromagnetic actuating element.

In order to prevent the end pieces of the staple mentioned above from slipping from the outer end of the corresponding coupling piston, it is provided to provide at least the outer ends of the corresponding coupling pistons with a recess in which the end piece then engages in the assembled state. Here it is especially advantageous when all ends of the coupling pistons are provided with the recess, so that an oriented assembly of the coupling pistons is unnecessary.

An especially low friction pivot connection of the inner lever on the axle piece is provided when, in the connection region, a roller bearing like a needle bearing is applied. Optionally, the arms of the inner lever could also sit tightly on the axle piece, wherein the axle piece can then rotate relative to the borehole in the head of the support element.

A simple guide of the pivoting outer lever is then provided when this, as proposed, is guided on end surfaces of the axle stumps that project slightly past the boreholes of the inner lever.

In one embodiment of the invention it is also provided that the inner lever has two advantageously continuous, beam-like side walls between which is held a roller or a plate for low-friction lifting-cam contact. Optionally, a sliding surface could also be applied at this position.

In addition, it is the subject matter of the invention to provide the top sides of the arms of the outer lever with vane-like, projecting sliding surfaces for run-on of, for example, low-stroke cams. Instead of these sliding surfaces, rollers or plates could also be applied.

A "double-flow" supply of the support element with hydraulic medium is also proposed. First, a hydraulic medium path should lead to the hydraulic play compensation device in the support element. Second, another hydraulic medium path goes into a storage space in the support element and from there in the direction toward the pressure space in the axle piece.

It is especially advantageous when the at least one rotary leg spring noted above is provided as the restoring spring. This is positioned with its windings, advantageously by a separate sleeve, on a cross axle that projects laterally from the inner lever and that sits in the region of the other end of the valve drive system, wherein overall two restoring springs or a restoring spring with connected inner legs are provided.

An inner leg of the restoring spring is snapped or bent according to the invention behind a holding opening of the inner lever, wherein an outer leg of the restoring spring acts under a stop on an outer side of the corresponding arm of the outer lever. For low-friction contact in the contact region, an involute profile is proposed.

A simple measure for reinforcing the outer lever is also provided in that the arms of the outer lever are connected on the bottom side by at least one reinforcement bracket. The latter could be provided as a height stop for the outer lever in its restoring direction, but does not have to be provided.

Finally, a simple stop for the coupling piston in the axle piece (decoupled position) is proposed. Here, for example, a simple snap ring, securing ring, or the like could be used. A pin projecting inward in the radial direction is also conceivable.

BRIEF DESCRIPTION OF THE DRAWINGS

The invention is explained in detail with reference to the drawing. Shown are.

DETAILED DESCRIPTION OF THE PREFERRED EMBODIMENTS

Figure 1:
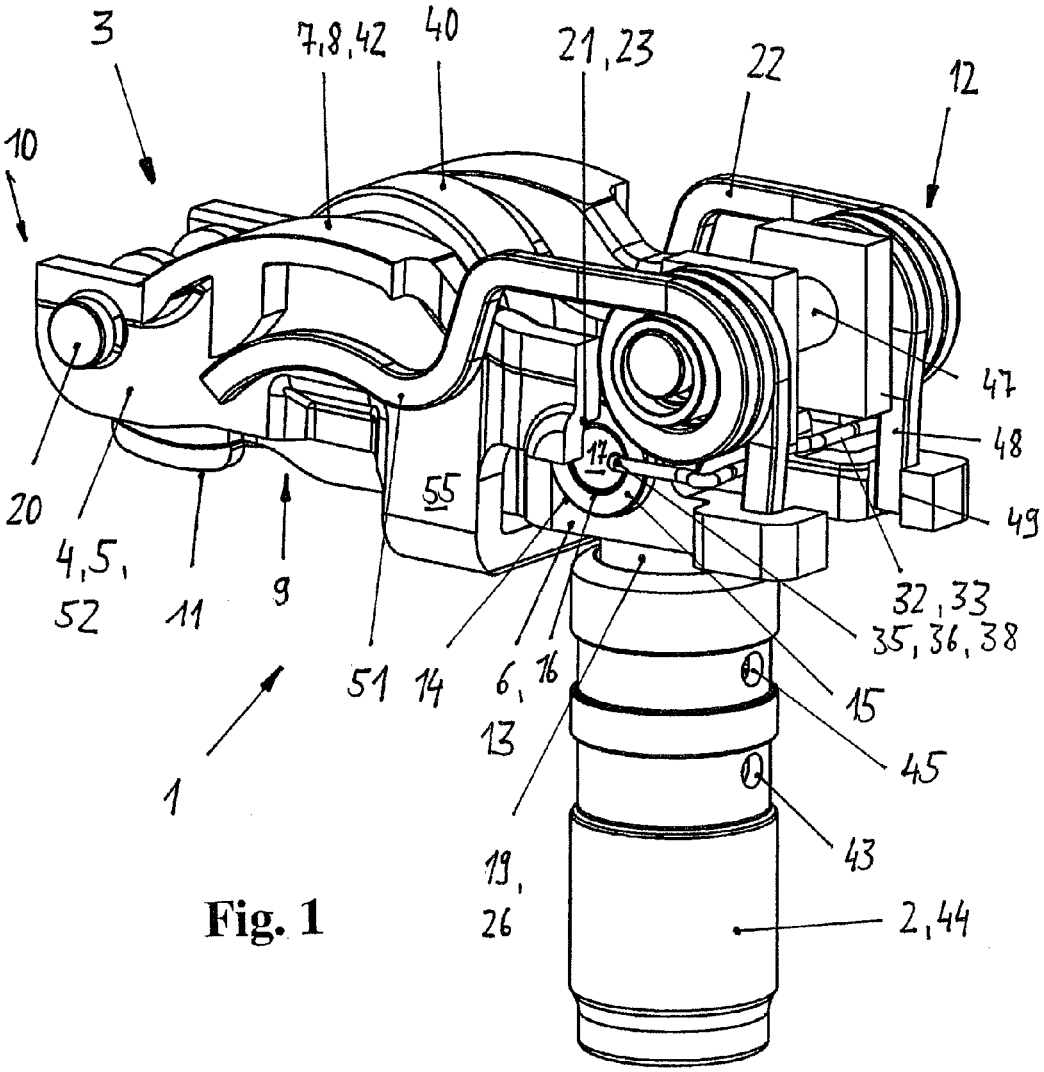
FIG. 1 is a perspective view of the valve drive system according to the invention.
Figure 2:
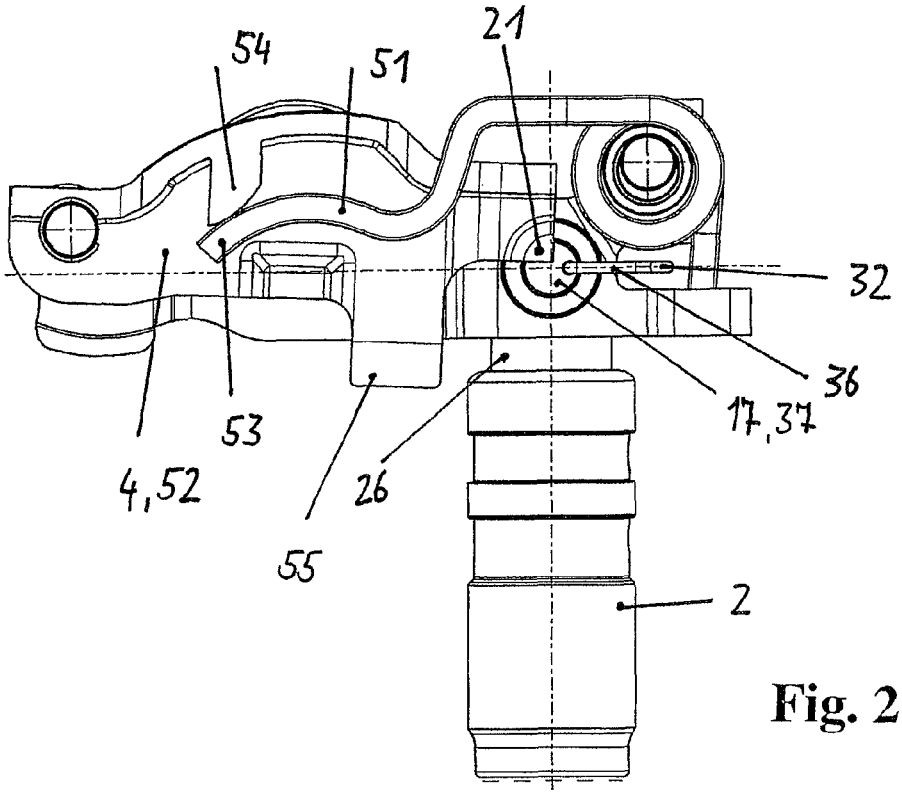
FIG. 2 is a side view of the valve drive system.

Shown is a valve drive system 1 with a hydraulic support element 2 and a switchable cam follower 3 connected to the support element in an articulated way. The latter is made from an elongated outer lever 4 with two arms 5. A similarly elongated inner lever 6 runs between the arms 5.

Run-on surfaces 8 projecting outward for large-stroke cams are shown integrally on a top side 7 of the arms 5 of the outer lever 4. These are constructed as sliding surfaces 42. Between its side walls 13, the inner lever 6 has, in contrast, a rotating and also rolling bearing supported roller 40 (see also FIG. 3) for contact of a low-stroke cam.

The inner lever 6 has on a bottom side 9 at a first end 10, a contact 11 for a gas-exchange valve. At the other end 12, the inner lever 6 has two opposite boreholes 14 between its side walls 13. A tubular axle piece 15 sits in the boreholes 14.

Figure 6:
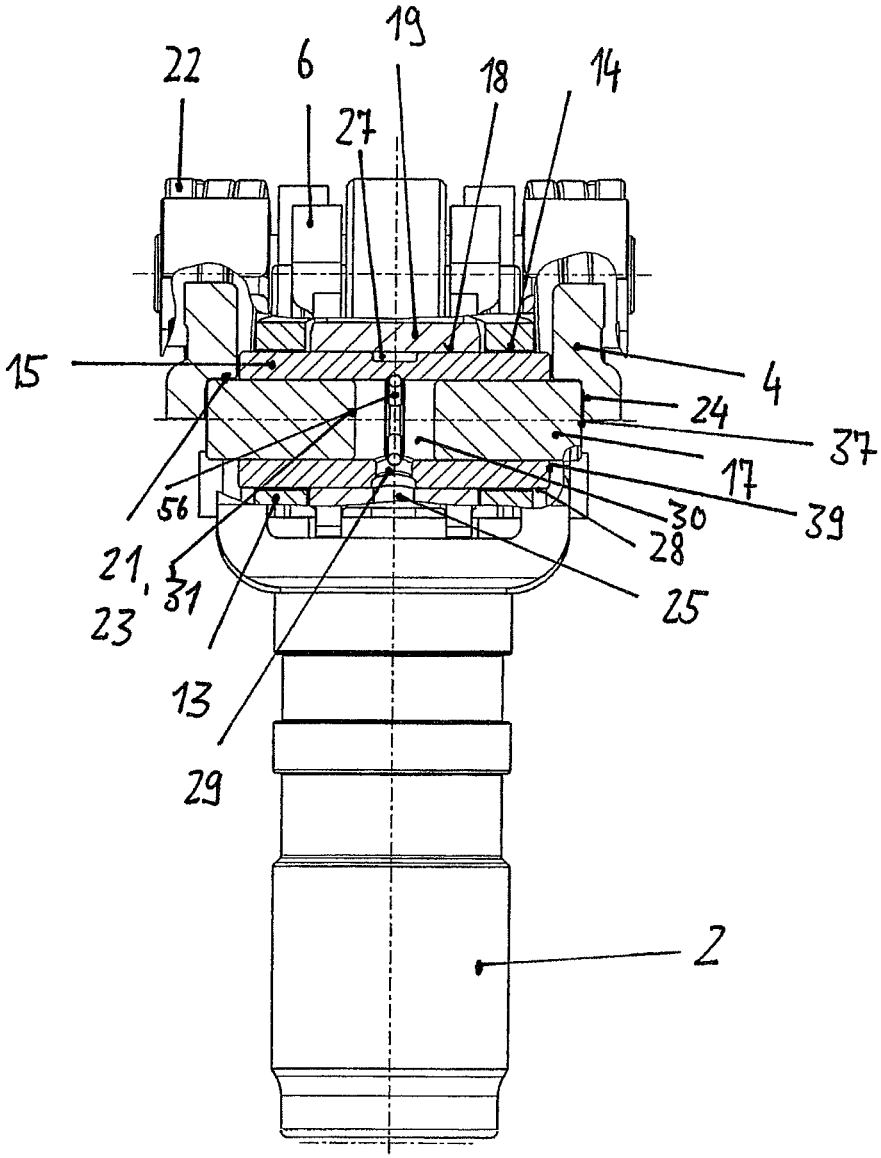
FIG. 6 is a cross-sectional view through the valve drive system in the region of the axle piece.

As is visible from FIG. 6, the axle piece 15 with its end surfaces 39 projects slightly past the inner lever 6. Simultaneously, in an opening 16 of the axle piece 15 run two diametrically opposed coupling pistons 17 whose outer and inner ends 37, 31 are each provided with a recess 38 (described in further detail below).

A stop element 56 that is constructed as a thin-walled ring and that is used for limiting a path for the coupling pistons 17 in their decoupling direction is allocated to the coupling piston 17 on the inside in the opening 16.

Figure 3:
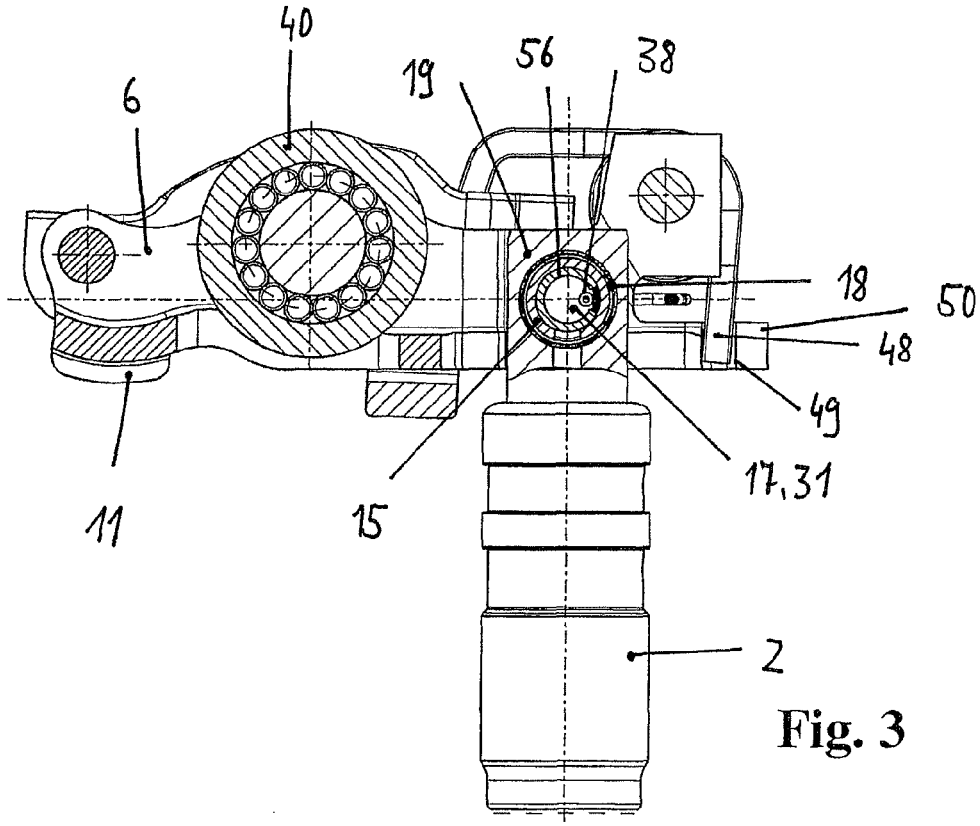
FIG. 3 is a view of the valve drive system as noted above, but with longitudinally cut levers.
Figure 4:
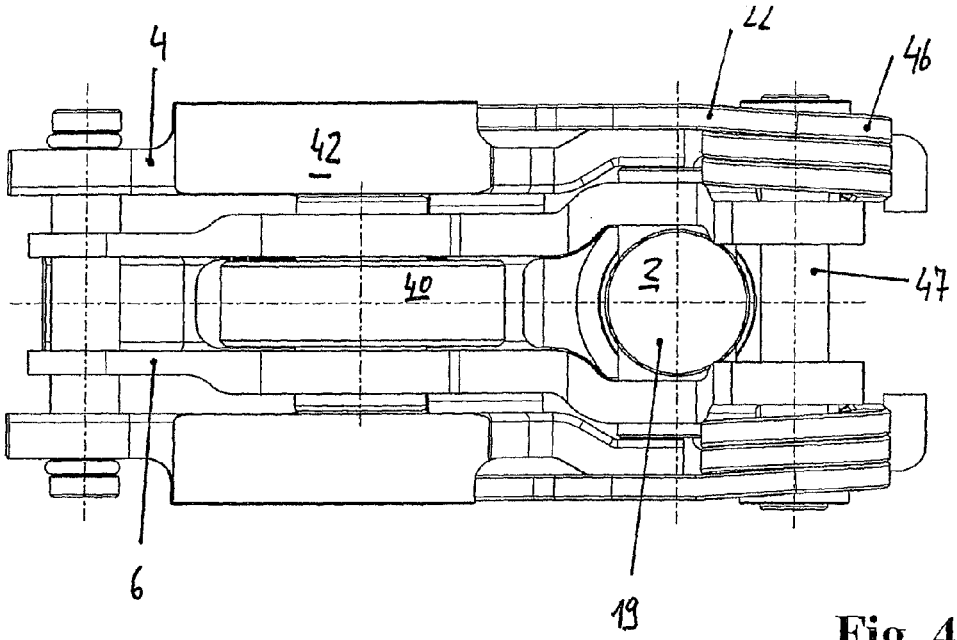
FIG. 4 is a top view of the valve drive system.
Figure 5:
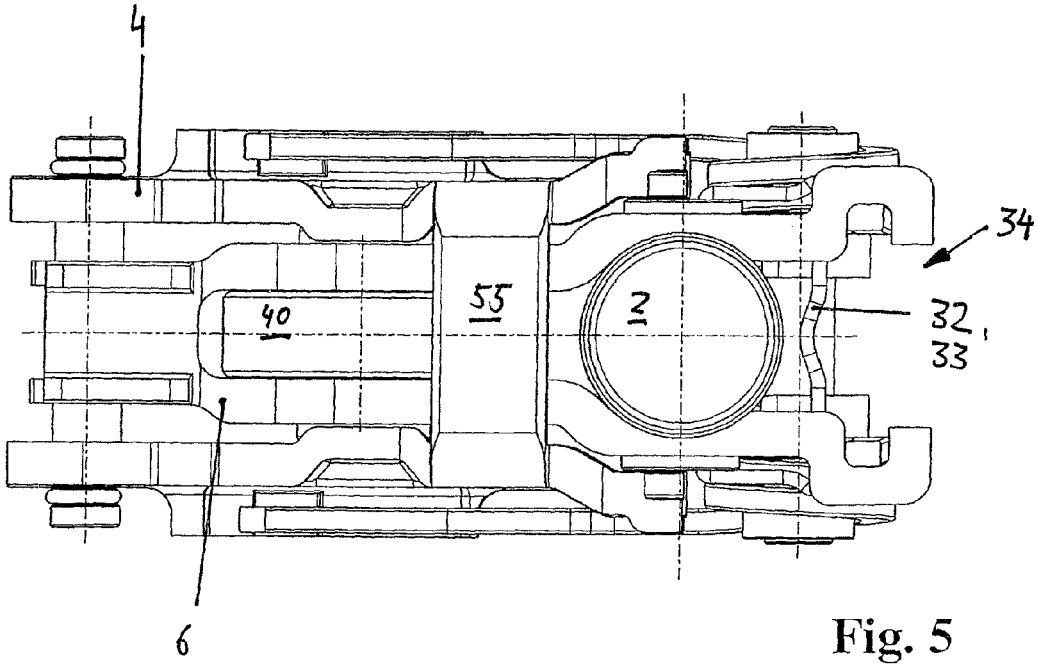
FIG. 5 is a bottom view of the valve drive system.

As is visible from FIG. 3, a head 19 of the support element 2 has a cross borehole 18 in which the axle piece 15 runs centrally. Thus, in this region there is an articulated and secure linking of the inner lever 6/cam follower 3 on the support element 2.

According to FIG. 1, in the region of a first end 10 runs a swivel pin 20 on which the levers 4, 6 are arranged so that they can pivot. The arms 5 of the outer lever 4 extend in the direction toward the other end 12 only up to the minimally projecting axle piece 15 and are connected at the bottom side 9 by a reinforcement bracket 55.

The arms 5 noted above for the outer lever 4 have an approximately quarter-shell-like segment 23 on the side of the other end 12 as a catch surface 21 for the coupling piston 17 in the coupled state.

As FIG. 6 discloses, in the coupled state, the hydraulically extended coupling pistons 17 engage with an upper subregion of their lateral surface region bordering their corresponding outer end 37 under the catch surface 21. In this way a pressure space 30 is formed in front of the inner ends 31 of the coupling pistons 17. The hydraulic medium is guided, starting from an upper inlet 45 in the housing 44, to a storage space not disclosed in the drawing in the support element 2. The hydraulic medium is further led from this storage space via a riser borehole 25 in a pressure piston 26 of the support element 2 into a central annular groove 27 in the outer lateral surface 28 of the axle piece 15. The annular groove 27 communicates, in turn, directly to the pressure space 30 with a radial channel 29 (here on the bottom) for the hydraulic medium.

As FIG. 1 also discloses, another inlet 43 for the hydraulic medium in the housing 44 lies axially underneath the inlet 45 noted above. This leads to a hydraulic play compensating device known sufficiently in this field of the art and not shown in more detail in the drawing in the support element 2. Thus, a hydraulically separated supply of the coupling device in the valve drive system 1 and the hydraulic play compensation device in the support element 2 is provided.

A displacement of the coupling pistons 17 in the decoupling direction is realized by the force of an outer spring 32 that is here constructed as a thin-walled staple. The staple has a middle piece 33 that lies behind an end area 34 of the levers 4, 6. Arms 36 project from the middle piece 33 on both sides in the direction toward the first end 10. The arms 36 have end pieces 35 that engage in the recesses 38 noted above in the outer end 37 of the corresponding coupling piston 17. For an extension movement of the coupling piston 17 in the coupling direction, the arms 36 of the spring means 32 are thus spread apart.

For a return displacement of the outer lever 4 pivoting relative to the inner lever 6 in the decoupled case, there are two restoring springs 22 that are formed as rotary leg springs. For supporting the restoring springs 22 there is a cross axle 47 that runs in the direct vicinity of the axle piece 15 in the side walls 13 of the inner lever 6 and projects outward like a stump past the side walls 13. Each stump-like projection extending outward in the cross axle 47 is enclosed by a sleeve on which sits the respective restoring spring 22 with its windings 46.

Each restoring spring 22 has an inner leg 48 that is snapped into a holding opening 49 on the other end 12 of the inner lever 6. The respective holding opening 49 is a component of a projecting holding clamp 50 projecting integrally from the inner lever 6.

The outer legs 51 of the restoring springs 22 extend on the outer sides 52 of the arms 5 of the outer lever 4 in the direction toward the first end 10. With their end 53, they are each guided under a projection 54 extending from a bottom side of the run-on surface 8. A special feature on the contact region is that here an involute profile is realized, so that only extremely low friction is to be taken into account.

Both lever parts 4, 6 are produced from thin-walled sheet steel using a stamping-bending method.

In the coupled state of the levers 3, 6, which emerges from FIG. 6, the entire cam follower 3 follows the stroke of the large-stroke cam contacting the run-on surfaces 8 on the outer lever 4. Should decoupling be realized and thus the cam follower 3 should follow only the stroke of the small-stroke cam contacting the roller 40 of the inner lever 6, then the hydraulic medium pressure on the inlet 45 of the housing 44 of the support element 2 is shut off or reduced and the coupling pistons 17 are brought out of contact from the catch surface 21 of the arms 5 of the outer lever 4 when passing through the cam base circle by the force of the spring 32 acting on these pistons and are displaced back completely into the opening 16 of the axle piece 15.

LIST OF REFERENCE NUMBERS

1) Valve drive system
2) Support element
3) Cam follower
4) Outer lever
5) Arm of outer lever
6) Inner lever
7) Top side of outer lever
8) Contact face
9) Bottom side
10) First end
11) Contact
12) Other end
13) Side wall
14) Borehole
15) Axle piece
16) Opening of axle piece
17) Coupling piston
18) Cross borehole of support element
19) Head
20) Swivel pin
21) Catch surface
22) Restoring spring
23) Segment
24) Inner end
25) Riser borehole
26) Pressure piston
27) Annular groove
28) Outer lateral surface of axle piece
29) Radial channel
30) Pressure space
31) Inner end of coupling piston
32) Spring
33) Middle piece
34) End region of lever
35) End piece
36) Arm
37) Outer end of coupling piston
38) Recess
39) End face of axle piece
40) Roll
42) Sliding surface
43) Inlet
44) Housing of support element
45) Inlet
46) Windings
47) Cross axle
48) Inner leg
49) Holding opening
50) Holding clamp
51) Outer leg
52) Outer side
53) End of outer leg
54) Stop
55) Reinforcement bracket
56) Stop element

The invention claimed is:

1. A valve drive system comprising a support element and switchable cam follower that is linked on the support element in an articulated way, wherein the cam follower includes an outer lever having arms between which an inner lever runs, at least the outer lever is provided on a top side thereof with a contact surface for a lifting cam, the inner lever has, on a bottom side on a first end, a contact for a gas-exchange valve and at least on the other end includes two side walls that are spaced apart and in which opposing boreholes extend, the side walls are bridged by a single, tubular axle piece that sits in the boreholes and includes an opening in which two diametrically opposed coupling pistons run, the single, tubular axle piece extends between the side walls in a cross borehole in a head of the support element, the levers run on a common swivel pin in a region of the first end and on the other end, the arms of the outer lever have a catch surface for the coupling pistons, the coupling pistons are brought out from the opening into engagement with the catch surfaces section-wise in a coupled state, such that a large valve stroke is realized and a comparatively smaller valve stroke or a zero valve stroke is provided for decoupling, the outer lever is forced back by a restoring spring from a pivoted mode, and the arms of the outer lever extend in a direction toward the other end only up to the axle piece and grip over the axle piece like a roof with a half-shell-like or quarter-shell-like segment as a catch surface, such that, for the coupled case, the coupling pistons can be extended section-wise under the catch surface and an extension thereof is limited at an inner end of the segment.

2. A valve drive system comprising a support element and switchable cam follower that is linked on the support element in an articulated way, wherein the cam follower includes an outer lever having arms between which an inner lever runs, at least the outer lever is provided on a top side thereof with a contact surface for a lifting cam, the inner lever has, on a bottom side on a first end, a contact for a gas-exchange valve and at least on the other end includes two side walls that are spaced apart and in which opposing boreholes extend, the side walls are bridged by a single, tubular axle piece that sits in the boreholes and includes an opening in which two diametrically opposed coupling pistons run, the single, tubular axle piece extends between the side walls in a cross borehole in a head of the support element, the levers run on a common swivel pin in a region of the first end and on the other end, the arms of the outer lever have a catch surface for the coupling pistons, the coupling pistons are brought out from the opening into engagement with the catch surfaces section-wise in a coupled state, such that a large valve stroke is realized and a comparatively smaller valve stroke or a zero valve stroke is provided for decoupling, the outer lever is forced back by a restoring spring from a pivoted mode, and the arms of the outer lever extend in a direction toward the other end only up to the axle piece and grip over the axle piece like a roof with a half-shell-like or quarter-shell-like segment as a catch surface, such that, for the coupled case, the coupling pistons can be extended section-wise under the catch surface and an extension thereof is limited at an inner end of the segment, wherein the coupling pistons are each shiftable in a respective opposite direction to achieve coupling by a hydraulic medium that is led out from the support element, the cross borehole of the head of the support element is cut from a riser borehole out from a storage space for the hydraulic medium of a pressure piston of the support element with the head, and the riser borehole leads to a central annular groove in an outer lateral surface of the axle piece out from which at least one radial channel for the hydraulic medium leads to a pressure space in front of inner ends of the coupling pistons.

3. A valve drive system comprising a support element and switchable cam follower that is linked on the support element in an articulated way, wherein the cam follower includes an outer lever having arms between which an inner lever runs, at least the outer lever is provided on a top side thereof with a contact surface for a lifting cam, the inner lever has, on a bottom side on a first end, a contact for a gas-exchange valve and at least on the other end includes two side walls that are spaced apart and in which opposing boreholes extend, the side walls are bridged by a single, tubular axle piece that sits in the boreholes and includes an opening in which two diametrically opposed coupling pistons run, the single, tubular axle piece extends between the side walls in a cross borehole in a head of the support element, the levers run on a common swivel pin in a region of the first end and on the other end, the arms of the outer lever have a catch surface for the coupling pistons, the coupling pistons are brought out from the opening into engagement with the catch surfaces section-wise in a coupled state, such that a large valve stroke is realized and a comparatively smaller valve stroke or a zero valve stroke is provided for decoupling, the outer lever is forced back by a restoring spring from a pivoted mode, the coupling pistons are displaceable in a decoupling direction by a force of at least one outer spring, and a staple or band clamp is used as the spring that bridges, with a middle piece thereof, an end region of the lever on the other end and acts with end pieces of its arms projecting from the middle piece against outer ends of the coupling pistons.

4. The valve drive system according to claim 3, wherein each of the ends of the coupling pistons have a recess for engagement to the end pieces of the spring, so that the coupling pistons can be mounted in a non-oriented way in the opening of the axle piece.

5. The valve drive system according to claim 1, wherein the axle piece projects slightly past the boreholes of the inner lever and the arms of the outer lever run directly on or in front of end faces of the axle piece.

6. The valve drive system according to claim 1, wherein the inner lever is made from two side walls that are generally continuous and between which a roller is held for the lifting cam contact.

7. The valve drive system according to claim 6, wherein top sides of the arms of the outer lever are provided with integral sliding surfaces projecting outward for contact by respective cams.

8. The valve drive system according to claim 1, wherein at least one of the levers is made from stamped and bent thin-walled sheet steel.

9. The valve drive system according to claim 2, wherein the support element has a hydraulic construction and a double-flow hydraulic medium supply, a hydraulic medium channel, starting from a separate inlet in the housing of the support element, leads to a hydraulic play-compensation device and a second hydraulic medium channel, starting from another inlet in the housing, leads to the storage space in the support element.

10. The valve drive system according to claim 1, wherein the restoring spring comprises at least one rotary leg spring that is positioned with its windings on a cross axle that projects laterally outward from the inner lever and that sits in a region of the other end of the inner lever directly surrounding the axle piece.

11. The valve drive system according to claim 10, wherein an inner leg of the restoring spring protrudes in a support element direction behind an end region of the levers and is snapped into a holding opening that runs approximately orthogonal to the longitudinal direction of the lever and that runs into a holding clamp projecting integrally from the inner lever on the other end thereof.

12. Valve drive system according to claim 10, wherein an outer leg of the restoring spring is guided on an outer sides of the arms of the outer lever in a direction toward the first end and an end of the restoring spring engages with an underside of a stop of the outer lever.

13. Valve drive system according to claim 12, wherein, in the contact region of the end of the outer leg of the restoring spring, an involute profile is shaped on the stop.

14. Valve drive system according to claim 1, wherein the arms of the outer lever are connected on the bottom side by a reinforcement bracket.

15. Valve drive system according to claim 1, wherein a stop element in the form of a ring for the coupling pistons is fixed centrally in the opening of the axle piece.

* * * * *